US006439133B1

(12) United States Patent
Jaramillo

(10) Patent No.: US 6,439,133 B1
(45) Date of Patent: Aug. 27, 2002

(54) PORTABLE TABLE DEVICE

(76) Inventor: Henry O. Jaramillo, 15342 Loretta Dr., La Mirada, CA (US) 90638

( * ) Notice: Subject to any disclaimer, the term of this patent is extended or adjusted under 35 U.S.C. 154(b) by 0 days.

(21) Appl. No.: 09/822,386

(22) Filed: Mar. 30, 2001

(51) Int. Cl.[7] ..... A47B 85/00
(52) U.S. Cl. ..... 108/25; 108/44
(58) Field of Search ..... 108/25, 26, 34, 108/35, 36, 38, 132, 50.01, 44, 45, 43; 5/110, 111

(56) References Cited

U.S. PATENT DOCUMENTS

| | | | | |
|---|---|---|---|---|
| 2,626,845 A | | 1/1953 | Dubach | |
| 2,646,577 A | * | 7/1953 | Thayer | |
| 3,044,080 A | * | 7/1962 | Hartwig | |
| 3,081,055 A | * | 3/1963 | Fuller | |
| 3,387,572 A | * | 6/1968 | Ulrich | |
| 3,606,112 A | | 9/1971 | Cheshier | |
| 4,243,249 A | | 1/1981 | Goss | |
| 4,909,159 A | | 3/1990 | Gonsoulin | |
| 4,927,128 A | * | 5/1990 | O'Brian | 108/36 X |
| 4,957,235 A | * | 9/1990 | Beno et al. | 108/25 X |
| 4,974,620 A | * | 12/1990 | Quillan et al. | 108/25 X |
| 5,070,795 A | * | 12/1991 | Redlin et al. | 108/25 X |
| 5,121,681 A | * | 6/1992 | Chang | 108/25 |
| 5,595,428 A | * | 1/1997 | Huang | 108/25 X |
| D407,245 S | | 3/1999 | Lewis | |
| 5,878,672 A | * | 3/1999 | Ostermann et al. | 108/25 X |
| 6,000,345 A | | 12/1999 | Gillotti | |

* cited by examiner

*Primary Examiner*—Jose V. Chen

(57) ABSTRACT

A portable table device for providing an easy transportable table for laptop computers. The portable table device includes a tabletop support frame; and also includes a plurality of legs being hingedly attached to the tabletop support frame; and further includes a tabletop assembly being attached to the tabletop support frame; and also includes a beverage holder assembly including a tray being extendably mounted to the tabletop support frame; and further includes an elongate storage container being securely attached to the tabletop support frame; and also includes a fastener assembly for securing the portable table device in folded storable position.

17 Claims, 2 Drawing Sheets

PORTABLE TABLE DEVICE

BACKGROUND OF THE INVENTION

1. Field of the Invention

The present invention relates to a portable and collapsible table and more particularly pertains to a new portable table device for providing an easy transportable table for laptop computers.

2. Description of the Prior Art

The use of a portable and collapsible table is known in the prior art. More specifically, a portable and collapsible table heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,909,159; U.S. Pat. No. 6,000,345; U.S. Pat. No. 2,626,845; U.S. Pat. No. 4,243,249; U.S. Pat. No. 3,606,112; and U.S. Pat. No. Des. 407,245.

While these devices fulfill their respective, particular objectives and requirements, the aforementioned patents do not disclose a new portable table device. The inventive device includes a tabletop support frame; and also includes a plurality of legs being hingedly attached to the tabletop support frame; and further includes a tabletop assembly being attached to the tabletop support frame; and also includes a beverage holder assembly including a tray being extendably mounted to the tabletop support frame; and further includes an elongate storage container being securely attached to the tabletop support frame; and also includes a fastener assembly for securing the portable table device in folded storable position.

In these respects, the portable table device according to the present invention substantially departs from the conventional concepts and designs of the prior art, and in so doing provides an apparatus primarily developed for the purpose of providing an easy transportable table for laptop computers.

SUMMARY OF THE INVENTION

In view of the foregoing disadvantages inherent in the known types of portable and collapsible table now present in the prior art, the present invention provides a new portable table device construction wherein the same can be utilized for providing an easy transportable table for laptop computers.

The general purpose of the present invention, which will be described subsequently in greater detail, is to provide a new portable table device which has many of the advantages of the portable and collapsible table mentioned heretofore and many novel features that result in a new portable table device which is not anticipated, rendered obvious, suggested, or even implied by any of the prior art portable and collapsible table, either alone or in any combination thereof.

To attain this, the present invention generally comprises a tabletop support frame; and also includes a plurality of legs being hingedly attached to the tabletop support frame; and further includes a tabletop assembly being attached to the tabletop support frame; and also includes a beverage holder assembly including a tray being extendably mounted to the tabletop support frame; and further includes an elongate storage container being securely attached to the tabletop support frame; and also includes a fastener assembly for securing the portable table device in folded storable position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable table device which has many of the advantages of the portable and collapsible table mentioned heretofore and many novel features that result in a new portable table device which is not anticipated, rendered obvious, suggested, or even implied by any of the prior art portable and collapsible table, either alone or in any combination thereof.

It is another object of the present invention to provide a new portable table device which may be easily and efficiently manufactured and marketed.

It is a further object of the present invention to provide a new portable table device which is of a durable and reliable construction.

An even further object of the present invention is to provide a new portable table device which is susceptible of a low cost of manufacture with regard to both materials and labor, and which accordingly is then susceptible of low prices of sale to the consuming public, thereby making such portable table device economically available to the buying public.

Still yet another object of the present invention is to provide a new portable table device which provides in the apparatuses and methods of the prior art some of the advantages thereof, while simultaneously overcoming some of the disadvantages normally associated therewith.

Still another object of the present invention is to provide a new portable table device for providing an easy transportable table for laptop computers.

Yet another object of the present invention is to provide a new portable table device which includes a tabletop support frame; and also includes a plurality of legs being hingedly attached to the tabletop support frame; and further includes a tabletop assembly being attached to the tabletop support frame; and also includes a beverage holder assembly including a tray being extendably mounted to the tabletop support frame; and further includes an elongate storage container being securely attached to the tabletop support frame; and also includes a fastener assembly for securing the portable table device in folded storable position.

Still yet another object of the present invention is to provide a new portable table device that is easy and convenient to set up and use.

Even still another object of the present invention is to provide a new portable table device that can be taken anywhere and can be stored in small spaces when not needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
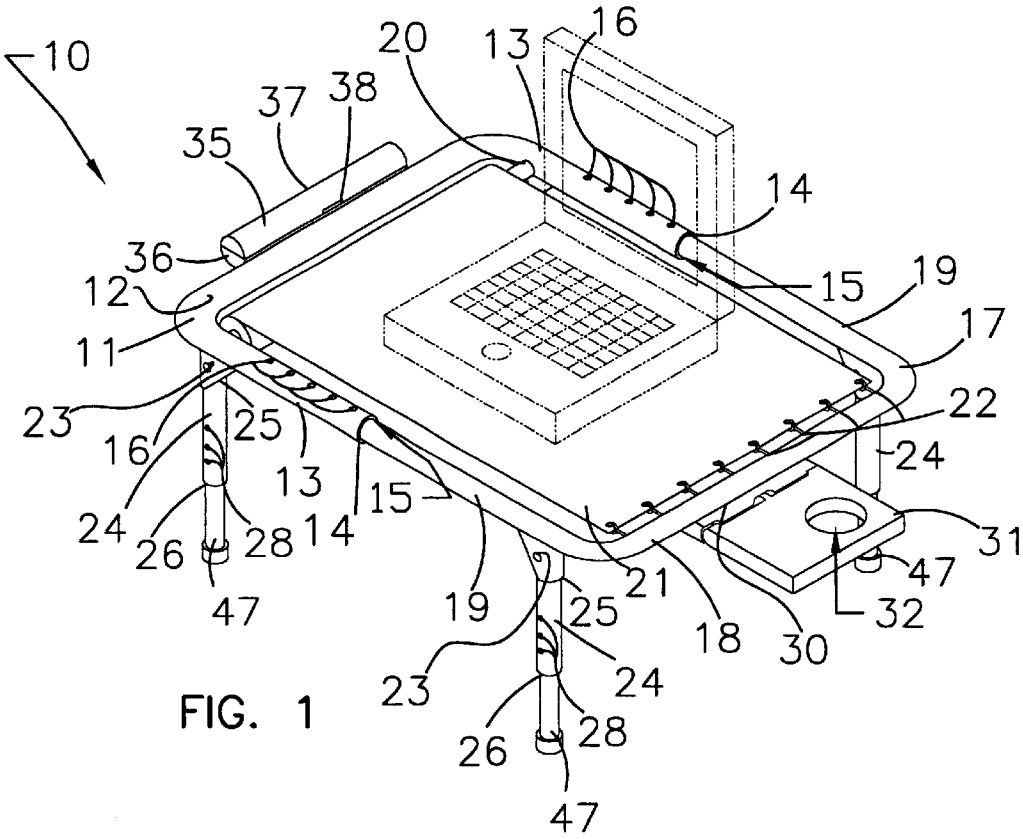
FIG. 1 is a top perspective view of a new portable table device according to the present invention.
Figure 2:
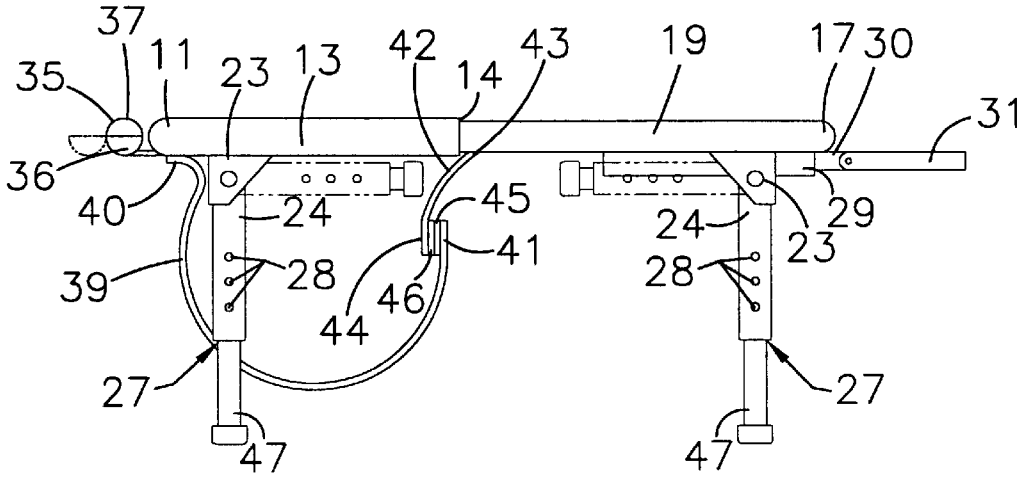
FIG. 2 is a side elevational view of the present invention.
Figure 3:
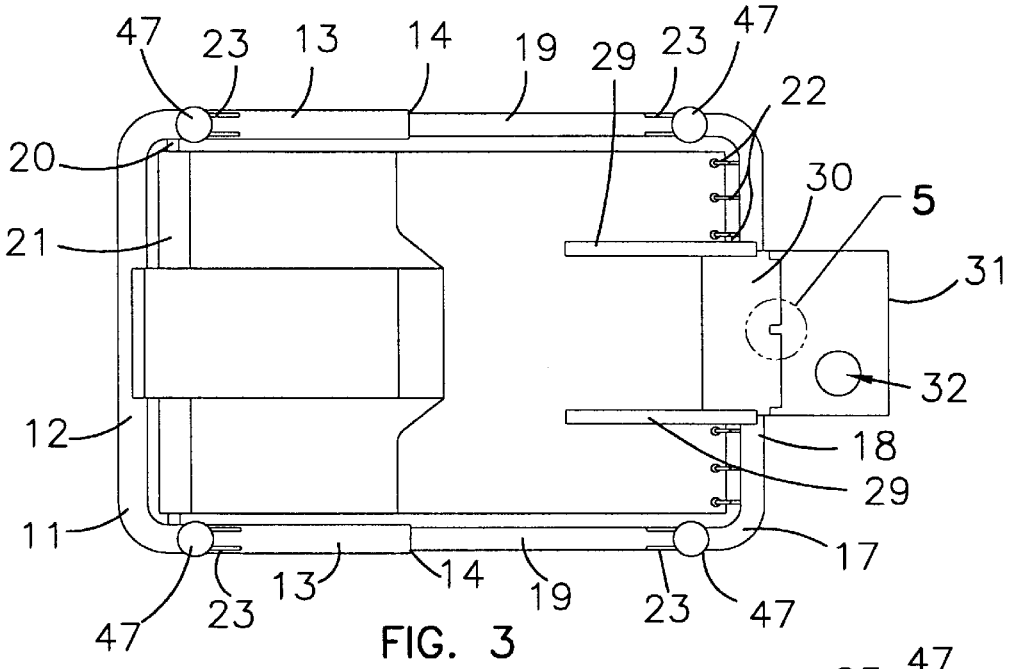
FIG. 3 is a bottom plan view of the present invention.
Figure 6:
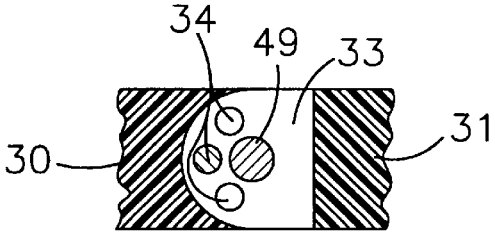
FIG. 6 is a cross-sectional view of the beverage holder of the present invention.
Figure 5:
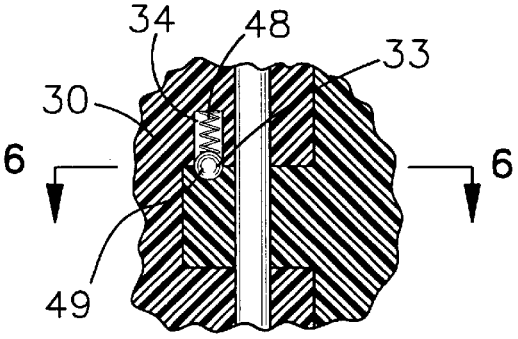
FIG. 5 is a detailed bottom plan view of the beverage holder of the present invention.
Figure 4:
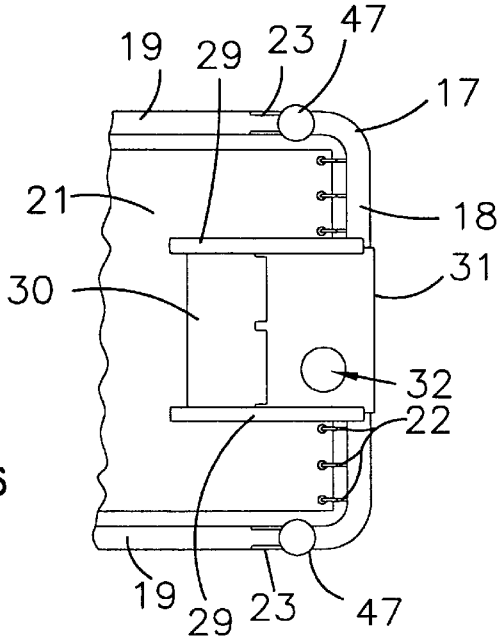
FIG. 4 is a detailed bottom plan view of the beverage holder of the present invention.

With reference now to the drawings, and in particular to FIGS. 1 through 6 thereof, a new portable table device embodying the principles and concepts of the present invention and generally designated by the reference numeral 10 will be described.

As best illustrated in FIGS. 1 through 6, the portable table device 10 generally comprises a tabletop support frame including a first U-shaped tubular member 11 and a second U-shaped tubular member 17 with each of the U-shaped tubular members 11,17 having an elongate main portion 12,18 and a pair of elongate end portions 13,19 which extend outwardly from the elongate main portion 12,18. Each of the elongate end portions 13 of the first U-shaped tubular member 11 has an open outer end 14 and also has a bore 15 extending therein through the open outer end 14 and further has a plurality of holes 16 being spaced apart and being disposed through a wall of the elongate end portion 13 and into the bore 15. The elongate end portions 13 of the first U-shaped tubular member 11 have a diameter greater than that of the elongate end portions 19 of the second U-shaped tubular member 17. The elongate end portions 19 of the second U-shaped tubular member 17 are telescopingly and fastenably received in the bores 15 of the elongate end portions 13 of the first U-shaped tubular member 11.

A plurality of legs are hingedly and conventionally attached to the tabletop support frame. The plurality of legs includes a plurality of bracket members 23 being securely and conventionally attached to near corners of the tabletop support frame, and also includes a plurality of elongate tubular members 24 each of which has a top end 25 being hingedly attached to a respective bracket member 23 and which also has an open bottom end 26 and which further has a bore 27 extending therein through the open bottom end 26 and which also has a plurality of holes 28 being spaced apart and being disposed through a wall of the elongate tubular member 24, and further includes a plurality of elongate extension members 47 having padded feet members and being telescopingly and fastenably received in the bores 27 of the elongate tubular members 24.

A tabletop assembly is conventionally attached to the tabletop support frame. The tabletop assembly includes a spindle 20 being rotatably mounted to the first U-shaped tubular member 11, and also includes a canvas member 21 being carried about the spindle 20 and being attachable with hooks 22 to the elongate main portion 18 of the second U-shaped tubular member 17. The canvas member 21 is extendable between the elongate main portions 12,18 and the elongate end portions 13,19 of the first and second U-shaped tubular members 11,17.

A beverage holder assembly includes a tray being extendably mounted to the tabletop support frame. The beverage holder assembly includes a pair of track members 29 being securely and conventionally attached to an underside of the canvas member 21. The tray is slidably received upon the pair of track members 29. The tray includes a first plate member 30 and a second plate member 31 being pivotally attached to the first plate member 30 and having a slot 32 being disposed therein. The slot 32 is adapted to receive and support a beverage container. The beverage holder assembly further includes a ball and spring joint 33 which connects the second plate member 31 to the first plate member 30 and which facilitates pivoting of the second plate member 31 relative to the first plate member 30 in a horizontal plane. The ball and spring joint 33 further includes a plurality of detents 34, a ball 49, and a spring 48 for biasing the ball in the detents 34;

An elongate storage container 35 is securely and conventionally attached to the tabletop support frame. The elongate storage container 35 is securely attached to and along the elongate main portion 12 of the first U-shaped tubular member 11, and includes a base member 36 which is securely and conventionally attached to the first U-shaped tubular member 11, and also includes a cover member 37 which is hingedly attached to the base member 36, and further includes a latch member 38 being conventionally attached to the cover member 37 for latching the cover member 37 upon the base member 36. The elongate storage container 35 is adapted to store accessories such as writing utensils.

A fastener assembly for securing the portable table device 10 in a collapsible and storable position includes a first strap member 39 having a first end 40 securely and conventionally attached to the tabletop support frame and also has a second end 41, and also includes a second strap member 42 having a first end 43 securely and conventionally attached to the tabletop support frame and also has a second end 44, and further includes strips of hook and loop fasteners 45,46 being securely and conventionally attached at the second ends 41,44 of the first and second strap members 39,42 and are attachable to one another to secure the first and second strap members 39,42 about the portable table device 10 for the compact storage thereof.

In use, the user extends and secures the second U-shaped tubular member 17 out of the first U-shaped tubular member 11, and then unfolds the elongate tubular members 24 from the bracket members 23 and extends and secures the elongate extension members 47 out of the elongate tubular members 24, and then unrolls the canvas member 21 from about the spindle 20 and hooks the canvas member 21 to the elongate main portion 18 of the second U-shaped member 17 to support a laptop computer. The user may extend the tray to support a beverage container, and may open the storage container 35 and retrieve and use any of the accessories being stored therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable table device comprising:

a tabletop support frame;

a plurality of legs attached to said tabletop support frame;

a tabletop assembly being attached to said tabletop support frame;

a beverage holder assembly including a tray being extendably mounted to said tabletop support frame;

an elongate storage container being attached to said tabletop support frame;

wherein said tabletop support frame includes a first U-shaped member and a second U-shaped member with each of said U-shaped members having an elongate main portion and a pair of elongate end portions which extend outwardly from said elongate main portion; and wherein each of said elongate end portions of said first U-shaped member has an open outer end and also has a bore extending therein through said open outer end, a plurality of holes being spaced apart and being disposed through a wall of said elongate end portion of said first U-shaped member and into said bore, said elongate end portions of said second U-shaped member being telescopingly received in said bores of said elongate end portions of said first U-shaped member.

2. A portable table device as described in claim 1, wherein said tabletop assembly includes a spindle being rotatably mounted to said first U-shaped tubular member, and also includes a canvas member being carried about said spindle and being attachable with hooks to said elongate main portion of said second U-shaped tubular member, said canvas member being extendable between said elongate main portions and said elongate end portions of said first and second U-shaped tubular members.

3. A portable table device as described in claim 2, wherein said beverage holder assembly includes a pair of track members being securely attached to an underside of said canvas member, said tray being slidably received upon said pair of track members.

4. A portable table device as described in claim 1, wherein said tray includes a first plate member and a second plate member being pivotally attached to said first plate member and having a slot being disposed therein, said slot being adapted to receive and support a beverage container.

5. A portable table device as described in claim 4, wherein said beverage holder assembly further includes a ball and spring joint which connects said second plate member to said first plate member and which facilitates pivoting of said second plate member relative to said first plate member and in a horizontal plane, said ball and joint further including a plurality of detents, a ball, and a spring for biasing said ball in said detents.

6. A portable table device as described in claim 1, wherein said plurality of legs includes a plurality of bracket members being securely attached to near corners of said tabletop support frame, and also includes a plurality of elongate tubular members each of which has a top end being hingedly attached to a respective said bracket member and which also has an open bottom end and which further has a bore extending therein through said open bottom end and which also has a plurality of holes being spaced apart and being disposed through a wall of said elongate tubular member, and further includes a plurality of elongate extension members being telescopingly and fastenably received in said bores of said elongate tubular members.

7. A portable table device as described in claim 1, wherein said elongate storage container is securely attached to and along said elongate main portion of said first U-shaped tubular member, and includes a base member which is securely attached to said first U-shaped tubular member, and also includes a cover member which is hingedly attached to said base member, and further includes a latch member being attached to said cover member for latching said cover member upon said base member, said elongate storage container being adapted to store accessories such as writing utensils.

8. A portable table device as described in claim 1, additionally comprising a fastener assembly for securing said portable table device in folded storable position, wherein said fastener assembly includes a first strap member having a first end securely attached to said tabletop support frame and also having a second end, and also includes a second strap member having a first end securely attached to said tabletop support frame and also having a second end, and further includes strips of hook and loop fasteners being securely attached at said second ends of said first and second strap members and being attachable to one another to secure said first and second strap members about said portable table device for the compact storage thereof.

9. A portable table device comprising:

a tabletop support frame, said tabletop support frame including a first U-shaped tubular member and a second U-shaped tubular member with each of said U-shaped tubular members having an elongate main portion and a pair of elongate end portions which extend outwardly from said elongate main portion, each of said elongate end portions of said first U-shaped tubular member having an open outer end and also having a bore extending therein through said open outer end and further having a plurality of holes being spaced apart and being disposed through a wall of said elongate end portion and into said bore, said elongate end portions of said first U-shaped tubular member having a diameter greater than that of said elongate end portions of said second U-shaped tubular member, said elongate end portions of said second U-shaped tubular member being telescopingly and fastenably received in said bores of said elongate end portions of said first U-shaped tubular member;

a plurality of legs being hingedly attached to said tabletop support frame, said plurality of legs including a plurality of bracket members being securely attached to near corners of said tabletop support frame, and also including a plurality of elongate tubular members each of which has a top end being hingedly attached to a respective said bracket member and which also has an open bottom end and which further has a bore extending therein through said open bottom end and which also has a plurality of holes being spaced apart and being disposed through a wall of said elongate tubular member, and further including a plurality of elongate extension members being telescopingly and fastenably received in said bores of said elongate tubular members;

a tabletop assembly being attached to said tabletop support frame, said tabletop assembly including a spindle being rotatably mounted to said first U-shaped tubular member, and also including a canvas member being carried about said spindle and being attachable with hooks to said elongate main portion of said second U-shaped tubular member, said canvas member being extendable between said elongate main portions and said elongate end portions of said first and second U-shaped tubular members;

a beverage holder assembly including a tray being extendably mounted to said tabletop support frame, said beverage holder assembly including a pair of track members being securely attached to an underside of said canvas member, said tray being slidably received upon said pair of track members, said tray including a first plate member and a second plate member being pivotally attached to said first plate member and having a slot being disposed therein, said slot being adapted to receive and support a beverage container, said beverage holder assembly further including a ball and spring joint which connects said second plate member to said first plate member and which facilitates pivoting of said second plate member relative to said first plate member and in a horizontal plane, said ball and joint further including a plurality of detents, a ball, and a spring for biasing said ball in said detents;

an elongate storage container being securely attached to said tabletop support frame, said elongate storage container being securely attached to and along said elongate main portion of said first U-shaped tubular member, and including a base member which is securely attached to said first U-shaped tubular member, and also including a cover member which is hingedly attached to said base member, and further including a latch member being attached to said cover member for latching said cover member upon said base member, said elongate storage container being adapted to store accessories such as writing utensils; and a fastener assembly for securing said portable table device in folded storable position, said fastener assembly including a first strap member having a first end securely attached to said tabletop support frame and also having a second end, and also including a second strap member having a first end securely attached to said tabletop support frame and also having a second end, and further including strips of hook and loop fasteners being securely attached at said second ends of said first and second strap members and being attachable to one another to secure said first and second strap members about said portable table device for the compact storage thereof.

10. A portable table device comprising:

a tabletop support frame;

a plurality of legs being hingedly attached to said tabletop support frame;

a tabletop assembly being attached to said tabletop support frame;

a beverage holder assembly including a tray being extendably mounted to said tabletop support frame;

an elongate storage container being securely attached to said tabletop support frame;

a fastener assembly for securing said portable table device in folded storable position;

wherein said tabletop support frame includes a first U-shaped tubular member and a second U-shaped tubular member with each of said U-shaped tubular members having an elongate main portion and a pair of elongate end portions which extend outwardly from said elongate main portion; and wherein each of said elongate end portions of said first U-shaped tubular member has an open outer end and also has a bore extending therein through said open outer end and further has a plurality of holes being spaced apart and being disposed through a wall of said elongate end portion and into said bore, said elongate end portions of said first U-shaped tubular member having a diameter greater than that of said elongate end portions of said second U-shaped tubular member, said elongate end portions of said second U-shaped tubular member being telescopingly and fastenably received in said bores of said elongate end portions of said first U-shaped tubular member.

11. A portable table device as described in claim 10, wherein said tabletop assembly includes a spindle being rotatably mounted to said first U-shaped tubular member, and also includes a canvas member being carried about said spindle and being attachable with hooks to said elongate main portion of said second U-shaped tubular member, said canvas member being extendable between said elongate main portions and said elongate end portions of said first and second U-shaped tubular members.

12. A portable table device as described in claim 11, wherein said beverage holder assembly includes a pair of track members being securely attached to an underside of said canvas member, said tray being slidably received upon said pair of track members.

13. A portable table device as described in claim 10, wherein said tray includes a first plate member and a second plate member being pivotally attached to said first plate member and having a slot being disposed therein, said slot being adapted to receive and support a beverage container.

14. A portable table device as described in claim 13, wherein said beverage holder assembly further includes a ball and spring joint which connects said second plate member to said first plate member and which facilitates pivoting of said second plate member relative to said first plate member and in a horizontal plane, said ball and joint further including a plurality of detents, a ball, and a spring for biasing said ball in said detents.

15. A portable table device as described in claim 10, wherein said plurality of legs includes a plurality of bracket members being securely attached to near corners of said tabletop support frame, and also includes a plurality of elongate tubular members each of which has a top end being hingedly attached to a respective said bracket member and which also has an open bottom end and which further has a bore extending therein through said open bottom end and which also has a plurality of holes being spaced apart and being disposed through a wall of said elongate tubular member, and further includes a plurality of elongate extension members being telescopingly and fastenably received in said bores of said elongate tubular members.

16. A portable table device as described in claim 10, wherein said elongate storage container is securely attached to and along said elongate main portion of said first U-shaped tubular member, and includes a base member which is securely attached to said first U-shaped tubular member, and also includes a cover member which is hingedly attached to said base member, and further includes a latch member being attached to said cover member for latching said cover member upon said base member, said elongate storage container being adapted to store accessories such as writing utensils.

17. A portable table device as described in claim 10, additionally comprising a fastener assembly for securing said portable table device in folded storable position, wherein said fastener assembly includes a first strap member having a first end securely attached to said tabletop support frame and also having a second end, and also includes a second strap member having a first end securely attached to said tabletop support frame and also having a second end, and further includes strips of hook and loop fasteners being securely attached at said second ends of said first and second strap members and being attachable to one another to secure said first and second strap members about said portable table device for the compact storage thereof.

* * * * *